US009771741B2

(12) United States Patent
Sljivic

(10) Patent No.: US 9,771,741 B2
(45) Date of Patent: Sep. 26, 2017

(54) DUAL CAM LOCK APPARATUS

(71) Applicant: T2 Systems Canada Inc., Burnaby (CA)

(72) Inventor: Aleksandar Sljivic, Burnaby (CA)

(73) Assignee: T2 Systems Canada Inc., Burnaby (CA)

( * ) Notice: Subject to any disclaimer, the term of this patent is extended or adjusted under 35 U.S.C. 154(b) by 249 days.

(21) Appl. No.: 14/681,975

(22) Filed: Apr. 8, 2015

(65) Prior Publication Data

US 2016/0208519 A1 Jul. 21, 2016

(30) Foreign Application Priority Data

Jan. 19, 2015 (CA) ..... 2878539

(51) Int. Cl.

| | |
|---|---|
| ***E05B 65/44*** | (2006.01) |
| ***E05B 63/14*** | (2006.01) |
| ***E05C 3/04*** | (2006.01) |
| *E05B 65/46* | (2017.01) |
| *E05B 65/462* | (2017.01) |

(52) U.S. Cl.

CPC ..... *E05B 65/44* (2013.01); *E05B 63/14* (2013.01); *E05C 3/042* (2013.01); *E05B 65/46* (2013.01); *E05B 65/462* (2013.01); *Y10S 70/42* (2013.01); *Y10S 292/62* (2013.01)

(58) Field of Classification Search

CPC ..... E05B 65/44; E05B 65/46; E05B 63/14; E05B 65/462; E05C 3/042; Y10S 292/68; Y10S 292/62; Y10S 70/42

USPC ..... 70/78–87, 150, 379 R, 379 A, 380, 70/DIG. 42; 312/215, 222; 292/95, 96, 292/99, 140, 159, 169, 169.14, 169.15, 292/194, 198, 240, DIG. 62

See application file for complete search history.

(56) References Cited

U.S. PATENT DOCUMENTS

| | | | | |
|---|---|---|---|---|
| 254,402 A * | 2/1882 | Stoddard | ..... | E05B 63/0017 70/134 |
| 660,736 A * | 10/1900 | Phelps | ..... | E05B 55/00 70/145 |
| 929,637 A * | 7/1909 | Thomas | ..... | E05B 59/00 70/107 |

(Continued)

FOREIGN PATENT DOCUMENTS

| | | |
|---|---|---|
| CA | 1037093 | 8/1978 |
| CA | 1041137 | 10/1978 |

(Continued)

*Primary Examiner* — Lloyd Gall

(74) *Attorney, Agent, or Firm* — Klarquist Sparkman, LLP

(57) ABSTRACT

A dual cam lock apparatus comprising a locking blade, a rotatable lock, a first cam and a second cam. The first cam comprises a first cam body and a first arm extending from the first cam body. The first cam is rotatable by the rotatable lock to move the first arm in and out of contact with the locking blade. The second cam comprises a second cam body with at least one slot therethrough which receives at least one protrusion of the first cam, and a second arm extending from the second cam body and coupled with the locking blade. The slot has an angular span across which the protrusion rotates before further rotation of the protrusion causes rotation of the second cam, whereby rotation of the second cam rotates the second arm to move the locking blade between the locking and release position.

29 Claims, 12 Drawing Sheets

(56) References Cited

U.S. PATENT DOCUMENTS 1,159,635 A * 11/1915 Wolfe et al. ..... E05B 59/00 292/244
1,278,553 A * 9/1918 Allmand ..... E05B 63/0013 70/139
1,417,963 A * 5/1922 Zawistowski ..... E05B 63/123 292/199
1,505,865 A * 8/1924 Costa ..... E05B 27/00 70/120
1,515,611 A * 11/1924 O'Connor ..... E05B 13/108 292/DIG. 68
1,892,446 A * 12/1932 Carr ..... E05B 65/025 292/DIG. 68
2,188,149 A * 1/1940 Kaiser ..... E05C 1/163 70/481
2,621,951 A * 12/1952 Ostadal ..... E05B 63/16 292/153
2,651,934 A * 9/1953 Chesler ..... E05B 55/00 292/359
2,976,714 A * 3/1961 Hofgesang ..... E05B 65/5223 70/210
3,062,033 A * 11/1962 Schmalfeldt ..... E05B 83/16 292/336.3
3,089,330 A * 5/1963 Kerr ..... E05B 5/003 292/251
3,374,021 A * 3/1968 Gulette ..... E05B 83/36 292/336.3
3,572,068 A * 3/1971 Carlson ..... E05B 47/0009 292/201
3,646,612 A * 2/1972 Anderson ..... F24C 15/022 292/200
3,695,068 A * 10/1972 Eads ..... E05B 59/00 292/5
4,155,233 A * 5/1979 Lira ..... E05B 15/004 292/111
4,534,192 A * 8/1985 Harshbarger ..... E05B 63/20 109/59 R
4,550,580 A * 11/1985 Neyret ..... E05B 17/04 70/370
4,563,885 A * 1/1986 Madden ..... E05B 13/004 70/105
4,683,733 A * 8/1987 Marin ..... E05B 63/0021 292/8
4,685,709 A * 8/1987 Kambic ..... E05B 47/0012 292/201
5,050,410 A * 9/1991 Claar ..... E05B 85/06 200/553
5,077,992 A * 1/1992 Su ..... E05B 59/00 292/36
5,193,370 A * 3/1993 Norden ..... E05B 17/04 70/120
5,249,443 A 10/1993 Anderson
5,556,142 A * 9/1996 Zankich ..... B64D 29/06 292/101
5,566,562 A * 10/1996 Fujii ..... E05B 17/04 70/262
5,857,364 A * 1/1999 Hsu ..... E05B 63/14 70/118
5,951,068 A 9/1999 Strong et al.
7,604,265 B2 * 10/2009 Tsai ..... E05B 63/06 292/116
7,905,521 B2 3/2011 Liang et al.
7,976,078 B2 * 7/2011 Steinbeck ..... E05B 17/0025 292/194
8,250,887 B2 8/2012 MacKay et al.
8,347,668 B2 * 1/2013 Min ..... E05B 59/00 292/165
8,628,126 B2 1/2014 Hagemeyer et al.

FOREIGN PATENT DOCUMENTS

| | | |
|---|---|---|
| CN | 2234994 | 9/1996 |
| CN | 202866462 | 4/2013 |
| EP | 1555365 | 7/2005 |
| GB | 2 402 424 | 12/2004 |
| GB | 2 455 777 | 6/2009 |
| JP | 60-143860 | 9/1985 |
| JP | 2001070592 | 3/2001 |
| JP | 2010159554 | 7/2010 |
| JP | 4746967 | 8/2011 |
| JP | 2013159958 | 8/2013 |
| KR | 200458427 | 6/2011 |
| WO | WO 94/10415 | 11/1994 |
| WO | WO 98/44227 | 10/1998 |
| WO | WO 2007/054728 A2 | 5/2007 |

* cited by examiner

DUAL CAM LOCK APPARATUS

TECHNICAL FIELD

The present disclosure relates to a dual cam lock apparatus for a locking blade that is movable between a locking and release position for releasably locking a housing. The disclosure also relates to a locking system for releasably locking a housing comprising the dual cam lock apparatus and a locking blade.

BACKGROUND

Housing, such as cabinets, drawers, chests and the like can be locked to prevent unauthorized access to internal space within the housing. For cabinets, the internal space is accessed by a cabinet door. These cabinets may be non-portable or portable such as those used to transport or store goods or valuables. One or more locking mechanisms, such as a moveable locking blade and releasable lock, may be provided for locking the cabinet door. The releasable lock is generally locked and opened by a key.

SUMMARY

According to a first aspect, there is provided a dual cam lock apparatus for a locking blade that is movable between a locking and release position for releasably locking a housing. The apparatus comprises a rotatable lock comprising a cam shaft, a first cam, and a second cam. The first cam comprises a first cam body rotationally coupled with the cam shaft, at least one protrusion upstanding from a surface of the first cam body, and a first arm extending from the first cam body configured to contact the locking blade to retain the locking blade in the locking position. The first cam is rotatable by the cam shaft to move the first arm in and out of contact with the locking blade. The second cam comprises a second cam body with at least one slot therethrough which receives the at least one protrusion, and a second arm extending from the second cam body and coupled with the locking blade. The slot has an angular span across which the protrusion rotates before further rotation of the protrusion causes rotation of the second cam, whereby rotation of the second cam rotates the second arm to move the locking blade between the locking and release position.

The dual cam lock apparatus may further comprise a support bracket with a support bracket aperture therethrough which receives the rotatable lock. The support bracket may comprise a jamming bracket with opposed openings through which the first arm extends when the first arm is in contact with the locking blade. The first arm may be configured to jam against an inside surface of the jamming bracket when there is forced movement of the locking blade.

The first arm may comprise a shoulder on a surface thereof configured to jam against the locking blade when there is forced movement of the locking blade.

The rotatable lock may be a cylinder lock with a first end comprising a keyhole for receiving a key and an opposed second end comprising the cam shaft.

The first cam body may comprise a first cam body aperture therethrough which receives the cam shaft and the outer profile of the cam shaft may correspond to the profile of the first cam body aperture.

The dual cam lock apparatus may further comprise a cam shaft fastener which fastens to the cam shaft to retain the first cam on the cam shaft. The cam shaft fastener may releasably fasten to the cam shaft. The second cam body may comprise a second cam body aperture therethrough which receives the cam shaft with the cam shaft fastener thereon with an annular space between the cam shaft fastener and the second cam body. The at least one slot may comprise a pair of opposed curved slots spaced around the second cam body aperture and the at least one protrusion may comprise a pair of protrusions, wherein each of the pair of protrusions is received in one of the curved slots.

The dual cam lock apparatus may further comprise a protrusion fastener which fastens to an end of the protrusion to couple the first cam to the second cam. The protrusion fastener may releasably fasten to the end of the protrusion.

The second arm may contact the locking blade and move the locking blade between the locking and release position. A surface of the second arm that contacts the locking blade may be curved.

According to a second aspect, there is provided a dual cam lock apparatus comprising a rotatable lock comprising a cam shaft, a first cam and a second cam. The first cam comprises a first cam body rotationally coupled with the cam shaft, at least one protrusion upstanding from a surface of the first cam body, and a first arm extending from the first cam body. The first cam is rotatable by the cam shaft between a lock and unlock position. The second cam comprises a second cam body with at least one slot therethrough which receives the at least one protrusion and a second arm extending from the second cam body. The slot has an angular span across which the protrusion rotates before further rotation of the protrusion causes rotation of the second cam.

According to a third aspect, there is provided a locking system for releasably locking a housing comprising the dual cam lock apparatus of the first or second aspect and a locking blade comprising one of a male or female engagement member for releasably engaging with the other of the male or female engagement member positioned on the housing. The second arm is coupled with the locking blade and rotation of the second cam rotates the second arm to move the locking blade between: a locking position whereby the male and female engagement members engage and the housing is locked; and a release position whereby the male and female engagement members disengage and the housing is unlocked. The first arm contacts the locking blade to retain the locking blade in the locking position. The first cam is rotatable by the cam shaft to move the first arm in and out of contact with the locking blade.

The locking blade may comprise a blade body and a tab in a plane substantially perpendicular to the blade body. The tab may comprise a slot and the second arm may extend through the slot and move the locking blade between the locking and release position through rotation of the second cam. The blade body may comprise a body portion and a neck portion and the tab may be upstanding from the neck portion. A surface of the second arm that is in contact with the tab during movement of the locking blade may be curved. The first arm may abut a surface of the tab to retain the locking blade in the locking position. The first arm may comprise a shoulder on a surface thereof and the surface of the tab may jam against the shoulder when there is forced movement of the locking blade.

The locking blade may comprise the male engagement member and the male engagement member may comprise one or more than one teeth on an edge of the locking blade.

The locking blade may move linearly between the locking and release position. The locking blade may comprise one or more than one slot therethrough for receiving a pin coupled to a surface of the housing. The slot may be dimensioned to allow linear movement of the locking blade between the locking and release position.

According to a fourth aspect, there is provided a housing comprising the locking system of the third aspect coupled to an inside surface of the housing for releasably locking the housing. The housing comprises one of the male or female engagement member for releasably engaging with the other of the male or female engagement member of the locking blade.

The housing may comprise a cabinet with a door. The locking system may be mounted on an internal surface of the cabinet and the door may comprise the one of the male or female engagement member.

This summary does not necessarily describe the entire scope of all aspects. Other aspects, features and advantages will be apparent to those of ordinary skill in the art upon review of the following description of specific embodiments.

BRIEF DESCRIPTION OF THE DRAWINGS

In the accompanying drawings, which illustrate one or more exemplary embodiments.

DETAILED DESCRIPTION

Directional terms such as "top", "bottom", "upwards", "downwards", "vertically" and "laterally" are used in the following description for the purpose of providing relative reference only, and are not intended to suggest any limitations on how any article is to be positioned during use, or to be mounted in an assembly or relative to an environment.

The embodiments described herein generally relate to a dual cam lock apparatus for a locking blade that is movable between a locking and release position. The locking blade can be used to releasably lock a housing, such as a cabinet, drawer, chest or the like. Also described are embodiments of a locking system for releasably locking a housing comprising the dual cam lock apparatus and a locking blade.

Figure 1:
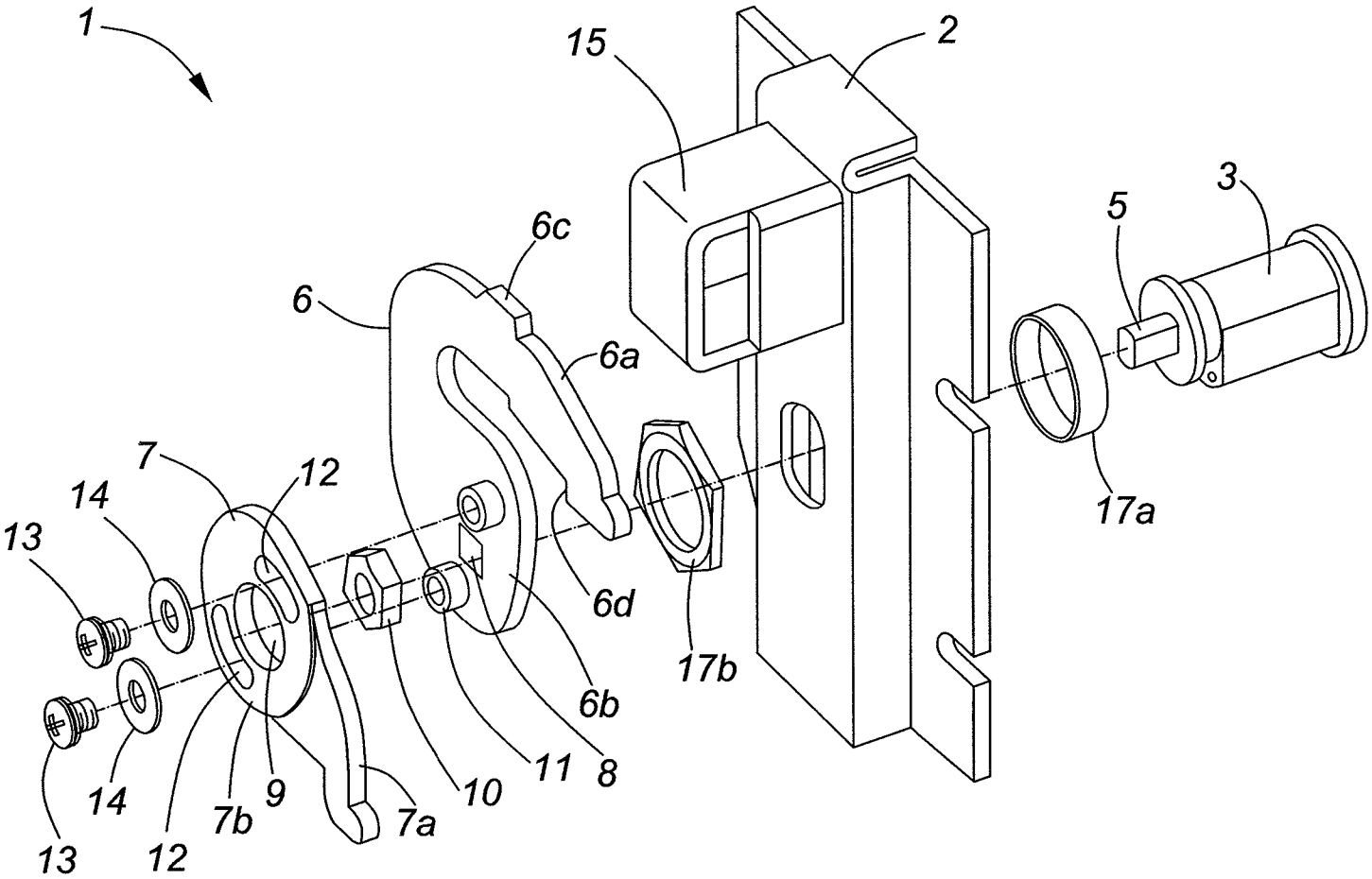
FIG. 1 is a perspective view of an exploded dual cam lock apparatus according to an embodiment.
Figure 9:
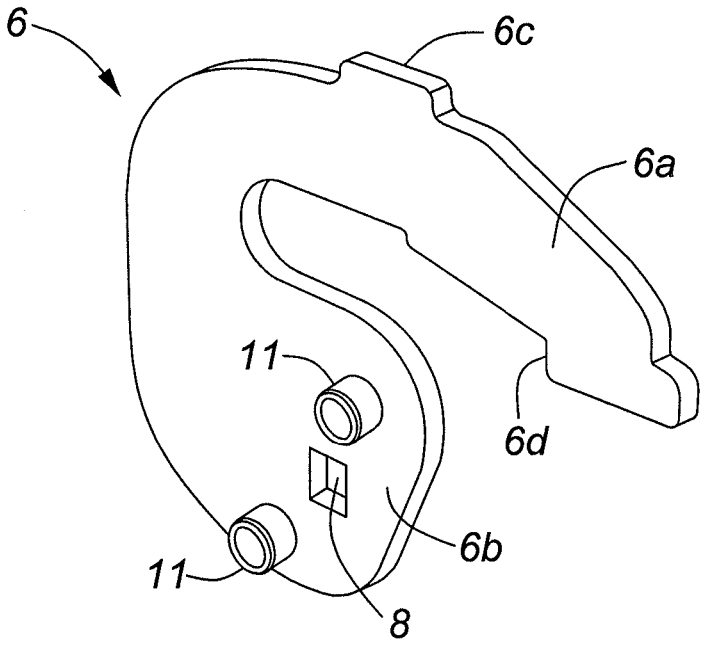
FIG. 9 is a perspective view of a locking cam of the dual cam lock apparatus according to an embodiment.
Figure 10:
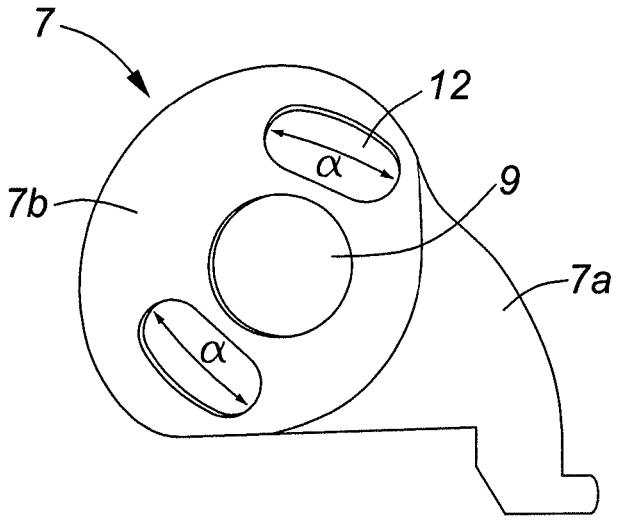
FIG. 10 is a perspective view of an actuating cam of the dual cam lock apparatus according to an embodiment.

Referring to FIGS. 1 and 2 there is respectively shown an exploded and assembled dual cam lock apparatus 1 according to an embodiment. The dual cam lock apparatus 1 comprises a support bracket 2 with an aperture therethrough which receives a cylinder lock 3. Rings 17*a* and 17*b* surround the cylinder lock 3 and are positioned either side of the support bracket 2. The cylinder lock 3 may be any cylinder lock or other type of rotatable lock known in the art. The cylinder lock 3 includes an outside end and an opposed inside end. The outside end of the cylinder lock 3 includes a key hole 4 (shown in FIGS. 4A and 8) configured to receive a key for locking and unlocking the dual cam lock apparatus 1. The inside end of the cylinder lock 3 includes a cam shaft 5 which receives a first cam (locking cam 6) and a second cam (actuating cam 7). The locking cam 6 is shown in more detail in FIG. 9 and comprises a cam body 6*b* and an arm 6*a* extending from the cam body 6*b*. The actuating cam 7 is shown in more detail in FIG. 10 and comprises a cam body 7*b* and an arm 7*a* extending from the cam body 7*b*. In the embodiment shown in FIGS. 1 and 2, the locking cam 6 is positioned between the actuating cam 7 and the support bracket 2, however in alternative embodiments (not shown), the actuating cam 7 may be positioned between the locking cam 6 and the support bracket 2.

The longitudinally extending cam shaft 5 has two opposed flat sides extending between opposed rounded ends. A portion of each of the rounded ends of the cam shaft has a threaded profile (not shown). A cam shaft aperture 8 through the cam body 6*b* of the locking cam 6 has a rectangular profile which receives the cam shaft 5. The flat sides of the cam shaft 5 prevent rotation of the cam shaft 5 within the aperture 8 such that rotation of the cam shaft 5 rotates the locking cam 6. The cam shaft 5 extends through the cam shaft aperture 8 and a threaded nut 10 is threaded onto the threaded potion of the cam shaft 5 to retain the locking cam 6 on the cam shaft 5. In alternative embodiments, the cam shaft 5 may have a different outer profile and the cam shaft aperture 8 a corresponding profile to receive the cam shaft 5 and facilitate rotation of the locking cam 6 through rotation of the cam shaft 5. In further alternative embodiments, any fastener known in the art may be fastened to the cam shaft 5 to retain the locking cam 6 on the cam shaft 5, for example a clip or bolt.

The cam body 6*b* of the locking cam 6 includes a pair of additional apertures which receive a pair of internally threaded standoffs (such as PEM® blind internally threaded standoffs—type BS04) which become permanently mounted in the locking cam 6 to form protrusions 11. As will be appreciated by a person skilled in the art, the protrusions 11 may be provided by any type of protrusion upstanding from the surface of the cam body 6*b* of the locking cam 6 and need not be provided by standoffs inserted in apertures in the cam body 6*b*.

The cam body 7*b* of the actuating cam 7 has a central aperture 9 therethrough which receives the cam shaft 5 with the nut 10 fastened thereon. The diameter of aperture 9 is larger than the outer profile of nut 10 such that there is an annular space between the nut 10 and the cam body 7*b* allowing the cam body 7*b* to freely rotate about the nut 10. The cam body 7*b* includes a pair of curved slots 12 in opposed alignment around the central aperture 9 and each of the slots 12 receives one of the protrusions 11 on the locking cam 6. A pair of washers 14 is received on a pair of threaded screws 13 and each of the threaded screws 13 with washer 14 thereon is threading into one of the internally threaded protrusions 11 such that the washers 14 and screw heads are positioned on the outer surface of the cam body 7*b* of the actuating cam 7. The threaded screws 13 couple the actuating cam 7 to the locking cam 6 without fastening the two cams 6, 7 together, such that the protrusions 11 are able to rotate within the slots 12. A person of skill in the art will readily understand that an alternative fastener may be fastened to the protrusions 11 to couple the actuating cam 7 to the locking cam 6. The angular span α of the slots 12 allows the protrusions 11 to rotate within the slots 12 and is selected to provide a rotational delay for the actuating cam 7, whereby the protrusions 11 of the locking cam 6 rotate across the angular span α before the protrusions 11 hit the wall of the slots 12 and further rotation of the locking cam 6 will cause rotation of the actuating cam 7. In alternative embodiments (not shown) a single protrusion 11 or three or more protrusions 11 may be upstanding from the surface of the cam body 6*b* of the locking cam 6, and a corresponding number of slots 12 may be provided in the cam body 7*b* of the actuating cam 7 to receive the protrusions 11.

In the assembled dual cam lock apparatus 1, the locking cam 6 and the actuating cam 7 have a common axis of rotation about the cam shaft 5. The cam shaft 5 is rotationally coupled to the locking cam 6 such that rotation of the cam shaft 5 rotates the locking cam 6. Furthermore, the locking cam 6 is rotationally coupled to the actuating cam 7 such that rotation of the locking cam 6 (after the rotational delay discussed above) causes rotation of the actuating cam 7.

Figure 2A:
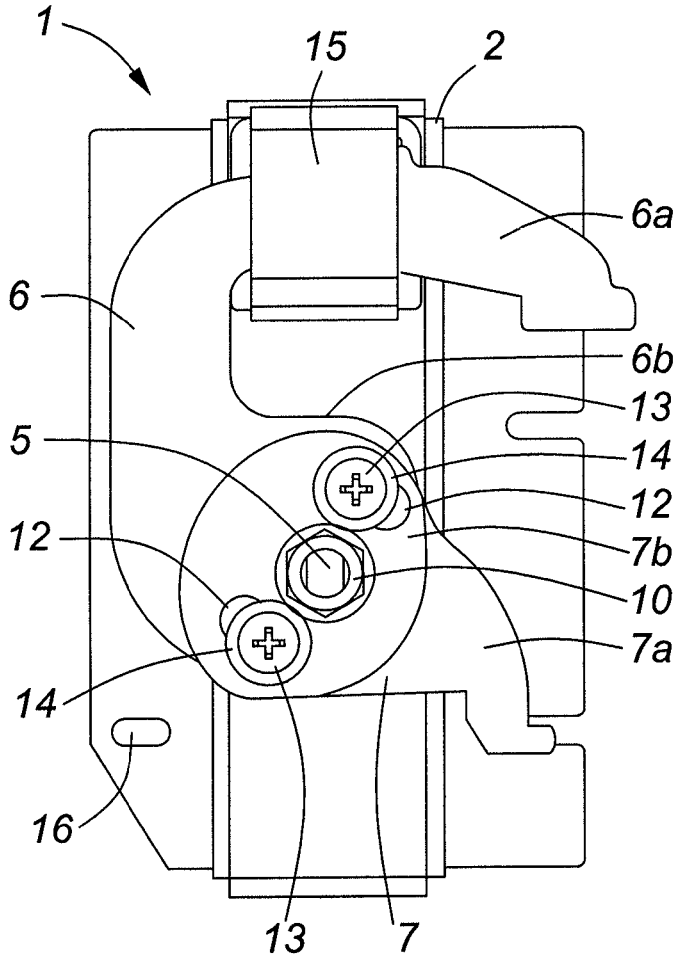
FIG. 2A is a front view and FIG. 2B is a perspective view of the assembled dual cam lock apparatus of FIG. 1.
Figure 2B:
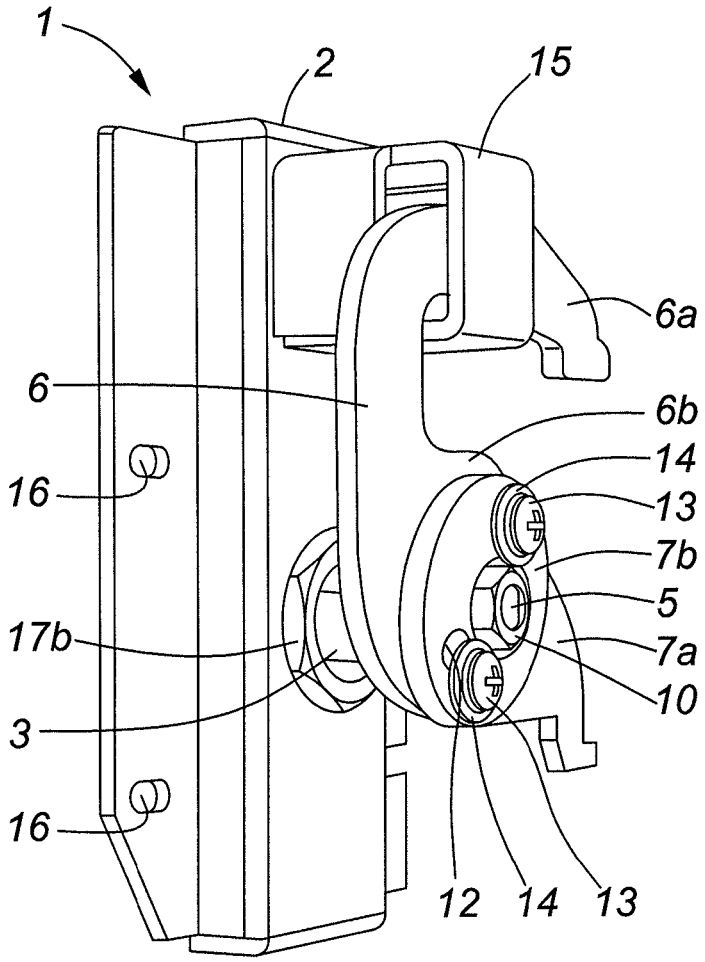

The support bracket 2 includes a jamming bracket 15 which receives the arm 6*a* of the locking cam 6. The jamming bracket 15 comprises a housing with opposed openings through which the arm 6*a* extends when the dual cam lock apparatus 1 is in a lock position as shown in FIGS. 2A and 2B.

Figure 3A:
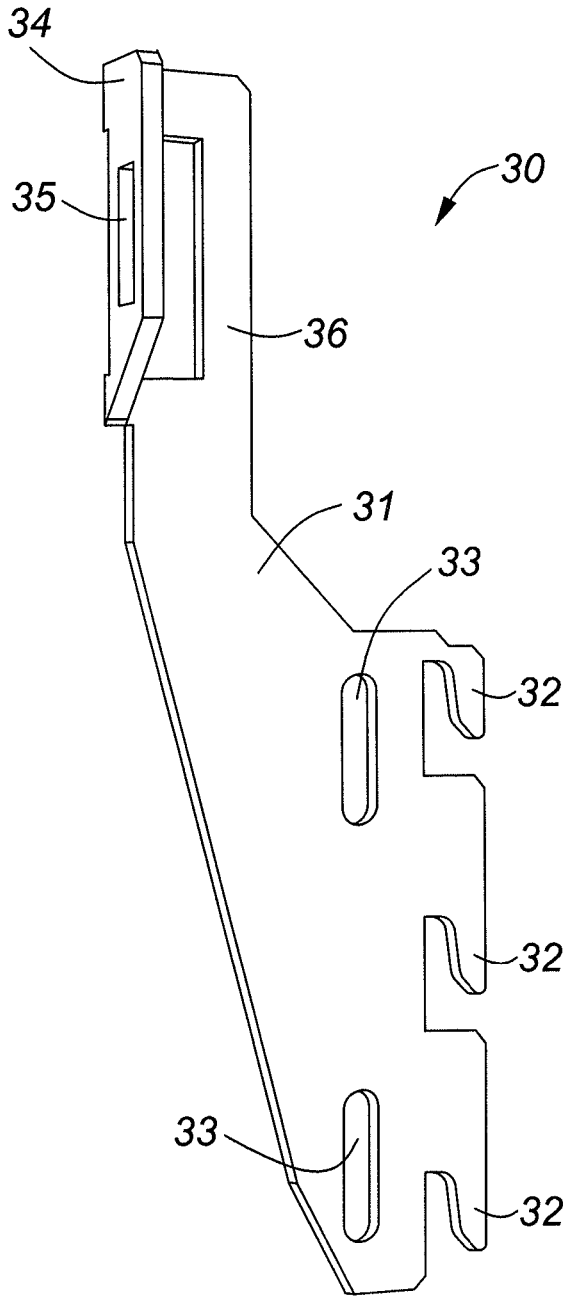
FIGS. 3A and 3B are perspective views of a locking blade according to different embodiments.
Figure 3B:
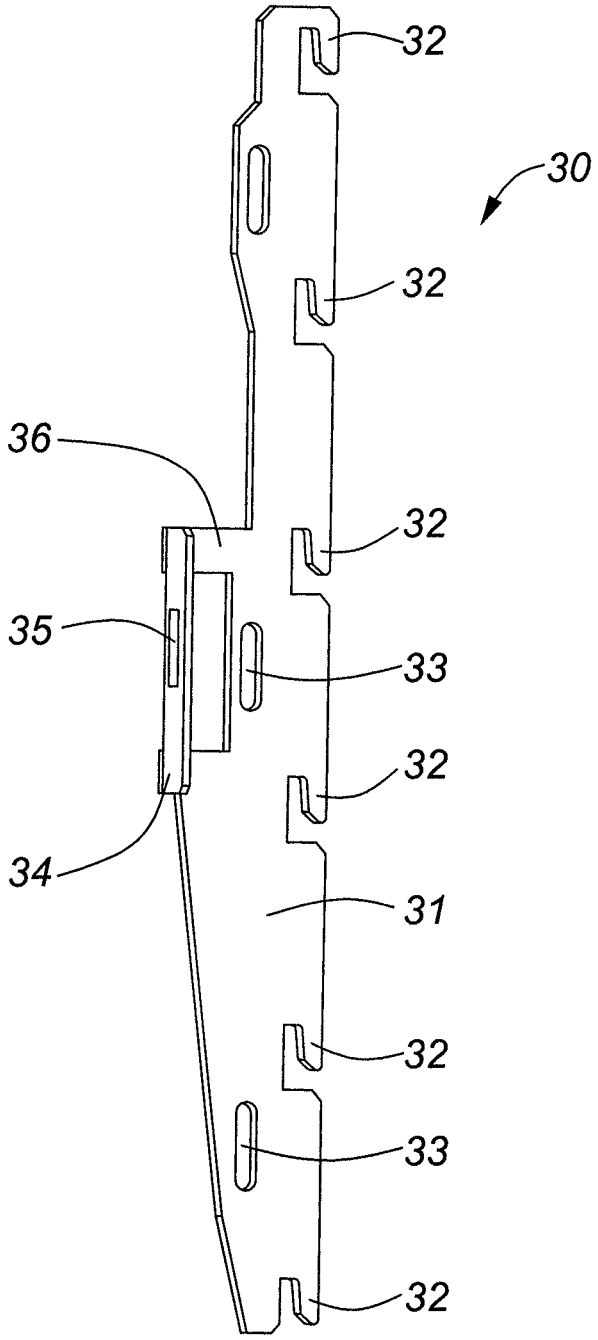

Referring now to FIGS. 3A and 3B, there is shown different embodiments of a locking blade 30 for use with the dual cam lock apparatus 1. The locking blade 30 generally comprises a flat, longitudinally extending body with a body portion 31 and a neck portion 36 which extends from the body portion 31. The neck portion 36 includes a tab 34 in a plane perpendicular to the body. The tab 34 includes a vertical slot 35 therethrough. The body portion 31 includes a plurality of male engagement members 32 comprising teeth positioned at spaced intervals along its outer edge which engage with female engagement members 41 on a cabinet door 40 as described below in more detail with reference to FIGS. 5-8. The body portion 31 includes a pair of vertical slots 33 therethrough. In alternative embodiments (not shown) the body portion 31 may have a single or multiple (more than two) slots therethrough.

Figure 4A:
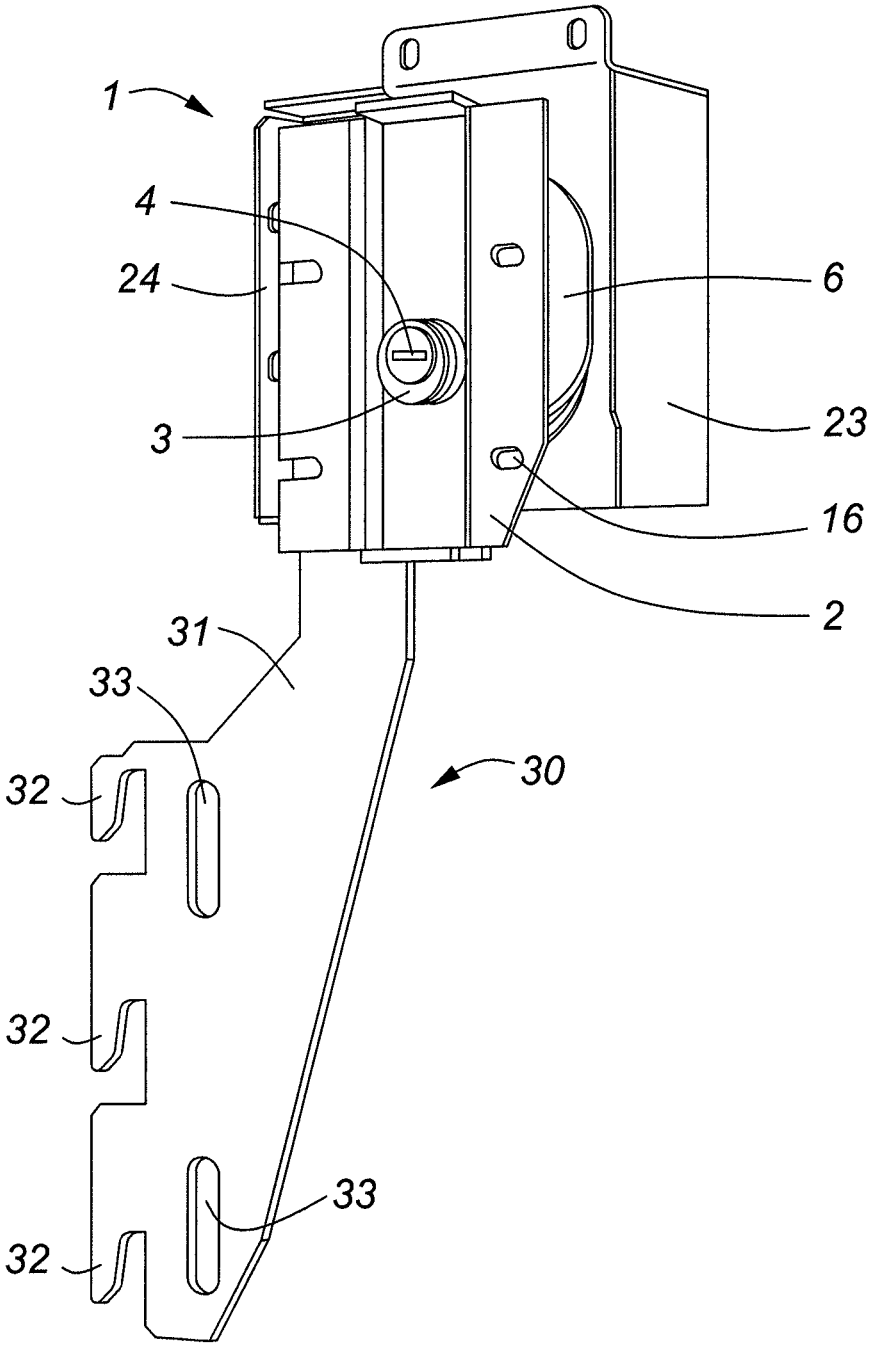
FIG. 4A is a front perspective view and FIG. 4B is a back perspective view of a locking system according to an embodiment comprising the dual cam lock apparatus and locking blade.
Figure 4B:
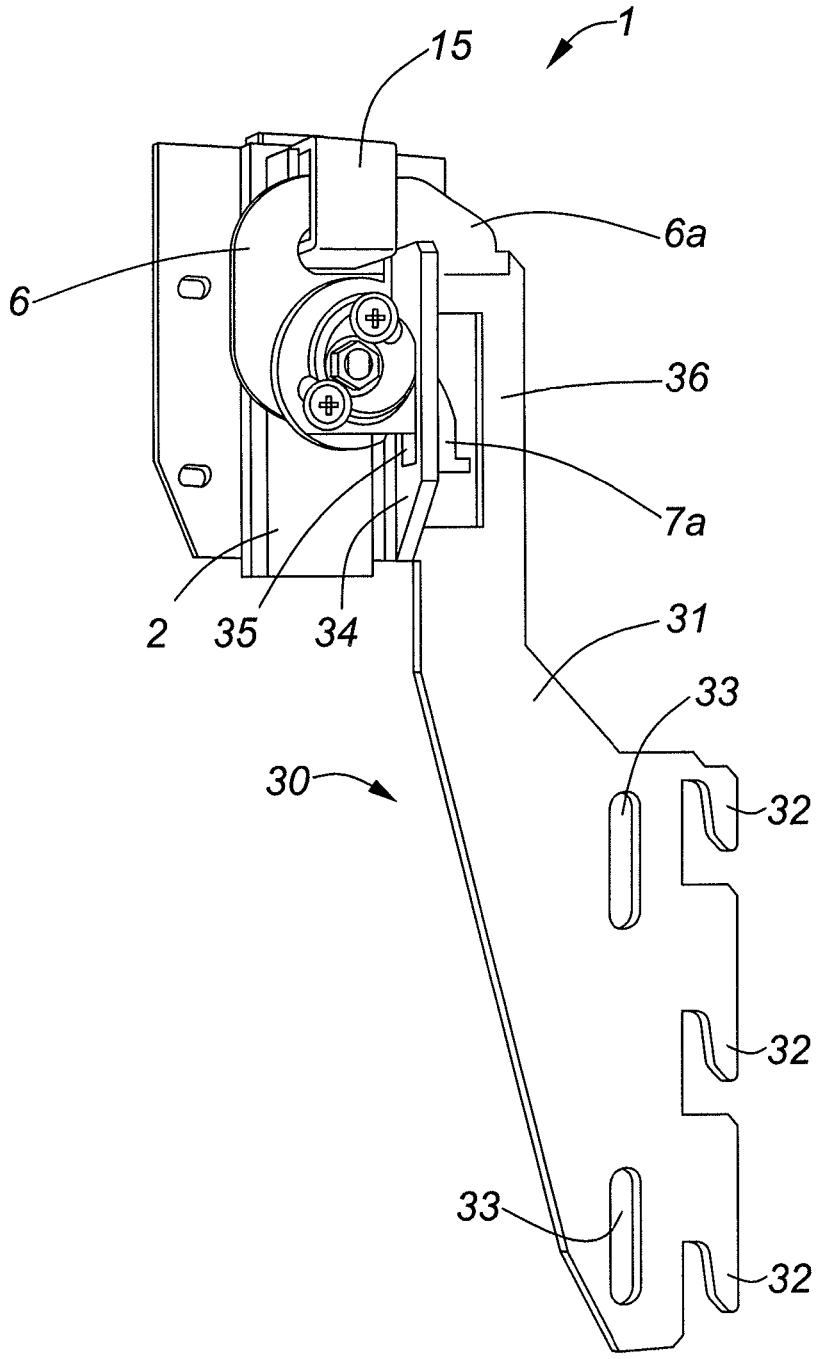

FIGS. 4A and 4B show a locking system according to an embodiment comprising the dual cam lock apparatus 1 and the locking blade 30 shown in FIG. 3A. The locking blade 30 is positioned adjacent the dual cam lock apparatus 1. Optional housing components 23 and 24 are positioned over the dual cam lock apparatus 1 to protect the apparatus as shown in FIG. 4A. In the embodiment shown In FIGS. 4A and 4B, the dual cam lock apparatus 1 is in the lock position with the arm 6*a* of locking cam 6 extending through the jamming bracket 15 and the lower surface of the arm 6*a* abutting the upper surface of the tab 34. The arm 7*a* of the actuating cam 7 extends through the slot 35 in the tab 34.

Figure 6:
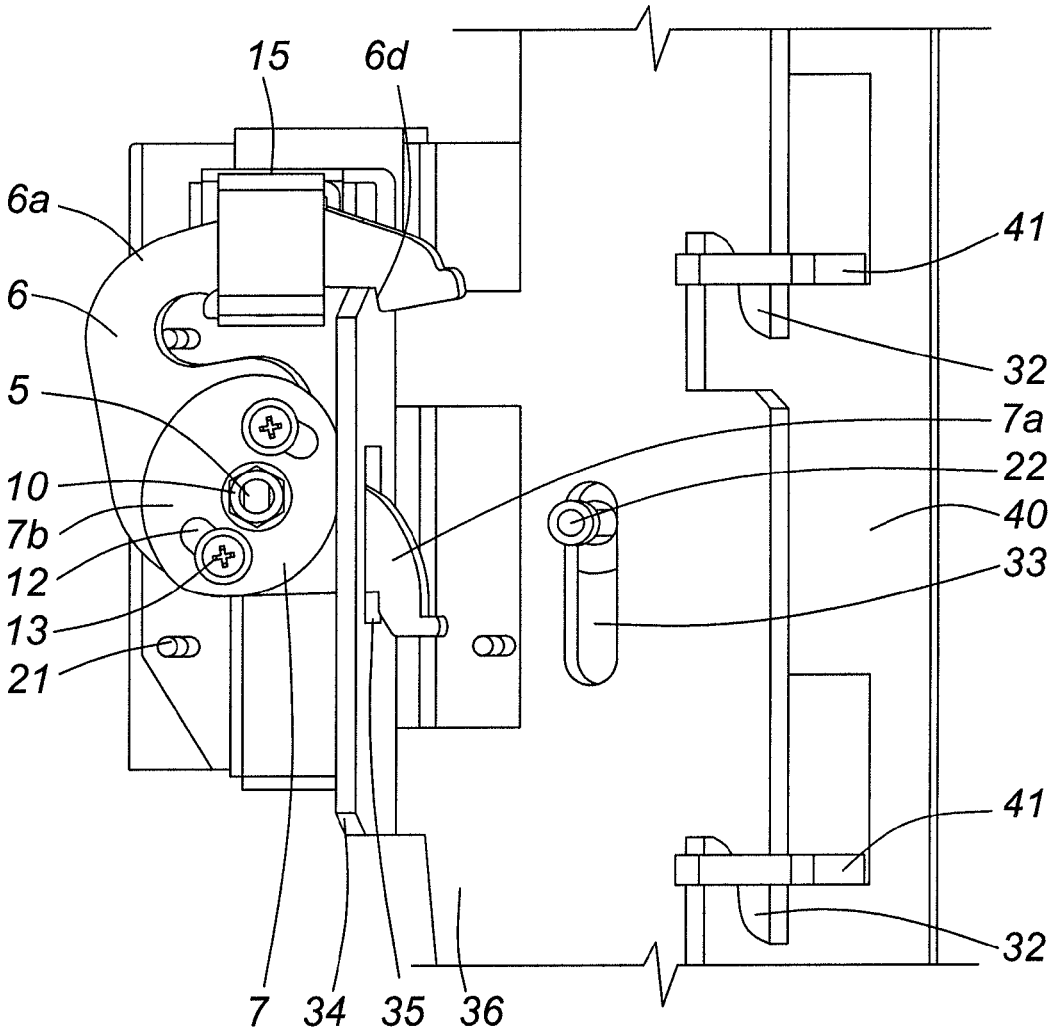
FIG. 6 is a perspective view of the locking system viewed from inside the cabinet, with the locking blade in locking engagement with the cabinet door and upward force being applied to the locking blade.
Figure 7:
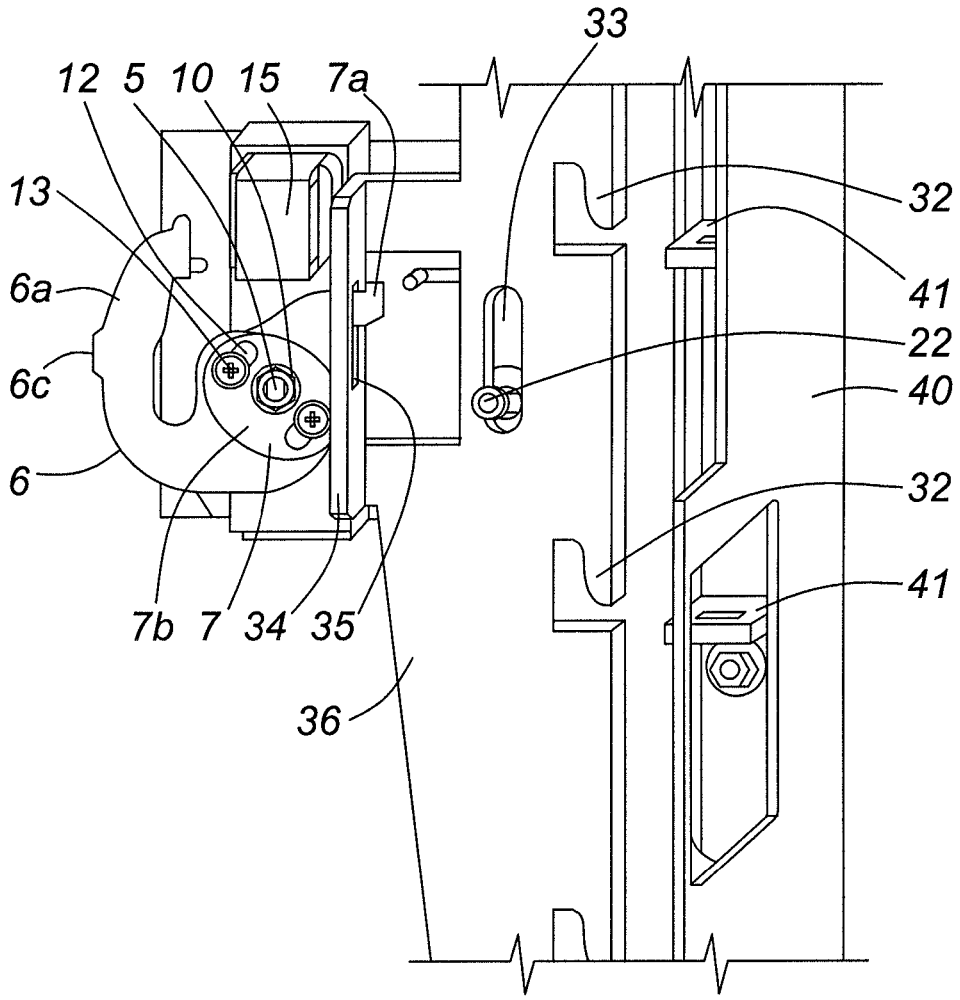
FIG. 7 is a perspective view of the locking system viewed from inside the cabinet, with the cabinet door released from locking engagement with the locking blade.
Figure 8:
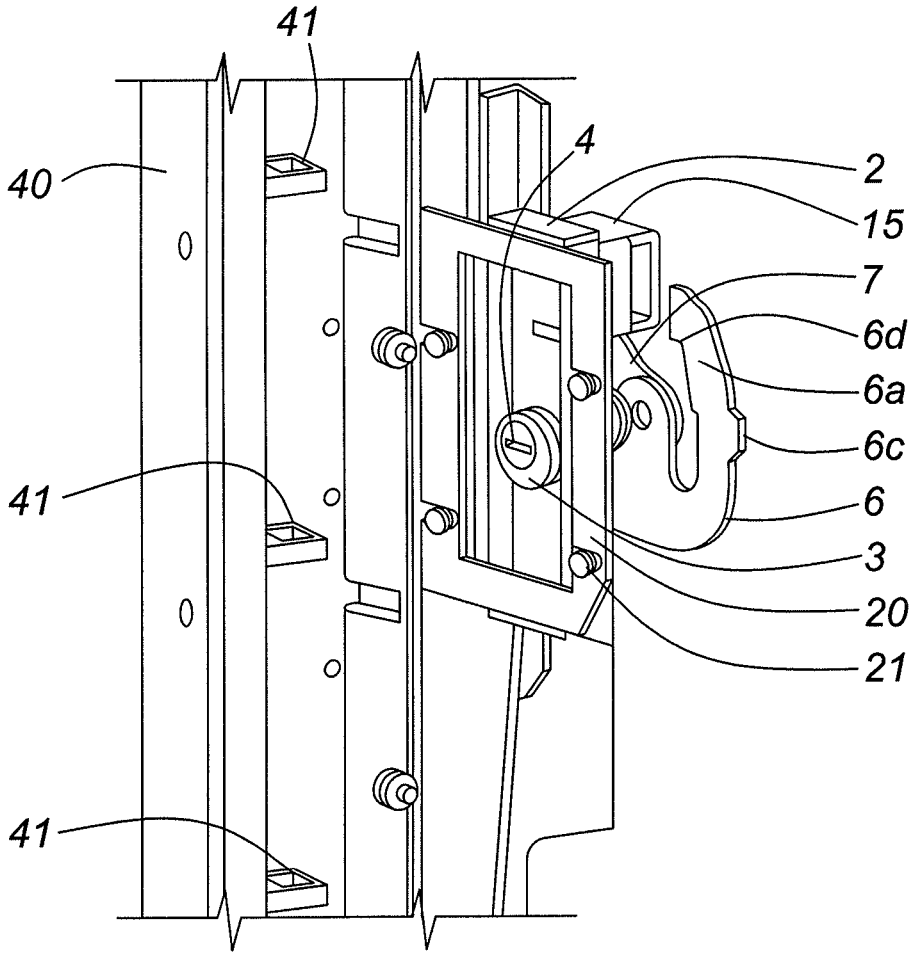
FIG. 8 is a perspective view of the locking system viewed from outside the cabinet, with the cabinet door released from locking engagement with the locking blade.

Referring now to FIGS. 5 to 8, there is shown a locking system according to an embodiment comprising the dual cam lock apparatus 1 and the locking blade shown in FIG. 3B. The locking system is mounted to a cabinet for releasably locking a cabinet door 40. The dual cam lock apparatus 1 is attached to a wall of a cabinet with a spacer plate 20 as shown in FIG. 8. The spacer plate 20 constrains a sliding cover plate (not shown) which covers the key hole 4 in cylinder lock 3. This cover plate is slid out of the way to expose the key hole 4 and allow insertion of the key. Holes or slots 16 in the support bracket 2 align with holes or slots in the spacer plate 20 and the aligned holes or slots receive a peg 21 which fastens the support bracket 2 and the spacer plate 20 to the cabinet wall. In alternative embodiments (not shown), the locking system may be mounted to the cabinet door 40.

Figure 5:
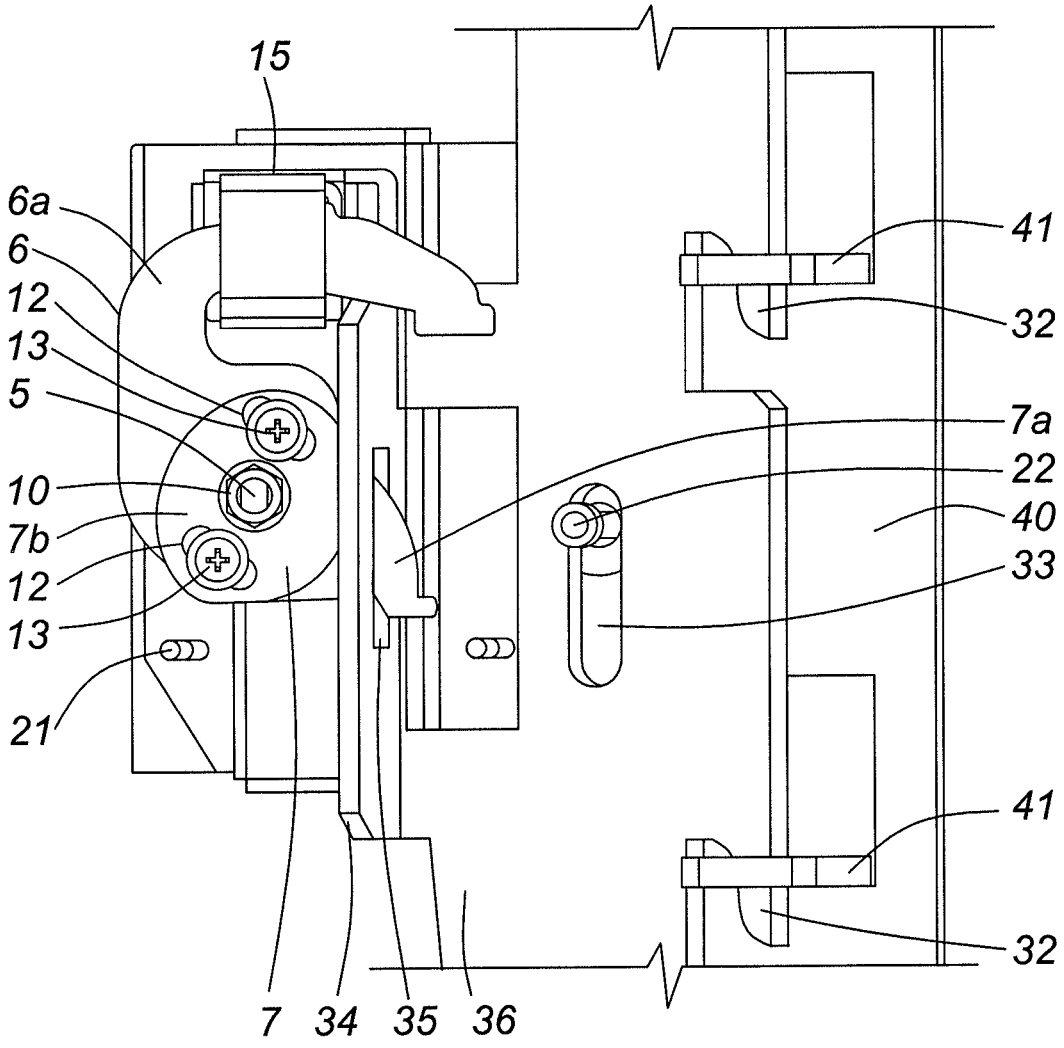
FIG. 5 is a perspective view of the locking system mounted to a cabinet viewed from inside the cabinet, with the locking blade in locking engagement with the cabinet door.

The locking blade 30 extends along an internal surface of the cabinet wall with the outer edge of body portion 31 adjacent to the outer edge of the cabinet wall. The male engagement members 32 of the locking blade 30 engage or mate with the female engagement members 41 to lock the cabinet door 40. More specifically, the teeth of the male engagement members 32 are received in openings through the female engagement members 41 when the locking blade 30 is in a locking position as shown in FIGS. 5 and 6. When the locking blade 30 is moved linearly upwards to a release position, the male engagement members 32 disengage from the female engagement members 41 to release the cabinet door 40 as shown in FIGS. 7 and 8. The slots 33 in the locking blade body 31 each receive a pin 22 which is connected to the cabinet wall. The pins 22 may be directly attached to the cabinet wall, fixed to a bracket which is attached to the cabinet wall, or connected in some other way to the cabinet wall. The length of the slot 33 is such that the locking blade 30 can move linearly between the locking position shown in FIGS. 5 and 6 and the release position shown in FIGS. 7 and 8.

In alternative embodiments (not shown) a single male engagement member 32 may be present which engages with a single female engagement member 41 on the cabinet door 40. The male engagement member(s) 32 and female engagement member(s) 41 may be any shape or size which releasable engage or mate with each other. In further alternative embodiments (not shown), the locking blade 30 may include one or more than one female engagement member 41 for releasably engaging with male engagement member(s) 32 positioned on the cabinet door 40.

To unlock and open the cabinet door 40, a key is inserted into the keyhole 4 and turned clockwise to rotate the cylinder lock 3 and cam shaft 5. Rotation of the cam shaft 5 rotates the locking cam 6 and the arm 6*a* is removed from the jamming bracket 15 as shown in FIGS. 7 and 8. As the locking cam 6 rotates the protrusions 11 rotate within the slots 12. The actuating cam 7 remains stationary as the protrusions 11 rotate across the angular span α of the slots 12 providing the rotational delay of the actuating cam 7 as described above. Once the protrusions 11 hit the wall of the slots 12, further rotation of the locking cam 6 rotates the actuating cam 7. As the actuating cam 7 rotates, the arm 7*a* pushes against the upper wall of the slot 35 in the tab 34 and actuates upwards linear movement of the locking blade 30 to disengage the male engagement members 32 from the female engagement members 41, and the cabinet door 40 can swing open as shown in FIGS. 7 and 8. The top surface of the arm 7*a* is rounded or curved which may beneficially provide smooth upwards vertical movement of the locking blade 30 as the locking blade 30 moves from the locking position shown in FIGS. 5 and 6 to the release position shown in FIGS. 7 and 8.

Somebody may try to pry open the cabinet door 40 by forcing the locking blade 30 upwards with a tool or the like to gain unauthorized access to the inside of the cabinet. In the event that the locking blade 30 is forced upwards as shown in FIG. 6, the tab 34 pushes against the arm 6*a* of the locking cam 6. The arm 6*a* moves upwards slightly and the cam body 6*b* rotates a small amount until a shoulder 6*d* on the lower surface of the arm 6*a* jams against the top surface of the tab 34 creating a first jamming point. Continued upward force of locking blade 30 causes the arm 6*a* of locking cam 6 to bend upwards a small amount. A second jamming point is created by a tab 6*c* on the top surface of the arm 6*a* (see FIG. 9) jamming against the inner surface of the jamming bracket 15. When the tab 6*c* contacts the inner surface of the jamming bracket 15 further bending of the arm 6*a* will be prevented. These two jamming points beneficially prevent further forced upwards movement of the locking blade 30 and the male engagement members 32 remain engaged with the female engagement members 41 preventing the cabinet door 40 from opening. The small amount of rotation of the locking cam 6 caused by the locking blade 30 being forced upward until the jamming points are reached does not bring about rotation of the actuating cam 7 because of the rotational delay provided by the angular span $\alpha$ of the slots 12 in the locking cam body 7*b* as discussed above in more detail. As shown in FIG. 6, the actuating cam 7 remains stationary and is not rotated to actuate movement of the locking blade 30 upwards to release the male engagement members 32 from the female engagement members 41. The prying force may therefore be redirected away from the actuating cam 7 and the actuating cam 7 may beneficially remain intact after an attempt to force the cabinet door open has been made.

The dual cam lock apparatus 1 may be assembled from its parts and there is no requirement for any springs or grease or other potentially unpredictable elements in the dual cam lock apparatus 1. The dual cam lock apparatus 1 can also be disassembled by unscrewing the screws 13 and the nut 10, enabling parts of the dual cam lock apparatus 1 to be repaired or replaced if needed. For example, if there was an attempted forced entry and the locking blade 30 was forced upwards, this could bend or damage the arm 6*a* of the locking cam 6 as it jammed against the inside surface of the jamming bracket 15. The damaged locking cam 6 may be replaced by disassembling the dual cam lock apparatus 1 as described above. This could be done while the dual cam lock apparatus 1 was still mounted to the cabinet.

The dual cam lock apparatus 1 can be provided as a pre-assembled apparatus to be retrofitted to a cabinet with a locking blade 30, or the components of the dual cam lock apparatus 1 may be provided as a kit to be assembled by the end user and fitted to a cabinet with a locking blade 30. The dual cam lock apparatus 1 may be provided with the spacer plate 20 to aid mounting of the dual cam lock apparatus 1 to the cabinet. The locking system (with optional spacer plate 20) may also be provided and retrofitted to cabinet. Alternatively, the cabinet may be provided with the locking system already mounted thereon.

In alternative embodiments, the dual cam lock apparatus 1 or the locking system may be fitted to any housing to releasable lock the housing, such as a drawer, chest or the like.

While particular embodiments have been described in the foregoing, it is to be understood that other embodiments are possible and are intended to be included herein. It will be clear to any person skilled in the art that modifications of and adjustments to the foregoing embodiments, not shown, are possible.

The invention claimed is:

1. A dual cam lock apparatus comprising:

a locking blade movable between a locking and release position;

a rotatable lock comprising a cam shaft;

a first cam comprising a first cam body rotationally coupled with the cam shaft, at least one protrusion upstanding from a surface of the first cam body, and a first arm extending from the first cam body configured to contact the locking blade to retain the locking blade in the locking position, wherein the first cam is rotatable by the cam shaft to move the first arm in and out of contact with the locking blade; and a second cam comprising a second cam body with at least one slot therethrough which receives the at least one protrusion, and a second arm extending from the second cam body and coupled with the locking blade, wherein the at least one slot has an angular span across which the at least one protrusion rotates before further rotation of the at least one protrusion causes rotation of the second cam, whereby rotation of the second cam rotates the second arm to move the locking blade between the locking and release position.

2. The dual cam lock apparatus of claim 1, further comprising a support bracket with a support bracket aperture therethrough which receives the rotatable lock.

3. The dual cam lock apparatus of claim 2, wherein the support bracket comprises a jamming bracket with opposed openings through which the first arm extends when the first arm is in contact with the locking blade, wherein the first arm is configured to jam against an inside surface of the jamming bracket when there is forced movement of the locking blade.

4. The dual cam lock apparatus of claim 1, wherein the first arm comprises a shoulder on a surface thereof configured to jam against the locking blade when there is forced movement of the locking blade.

5. The dual cam lock apparatus of claim 1, wherein the rotatable lock is a cylinder lock with a first end comprising a keyhole for receiving a key and an opposed second end comprising the cam shaft.

6. The dual cam lock apparatus of claim 1, wherein the first cam body comprises a first cam body aperture therethrough which receives the cam shaft and the outer profile of the cam shaft and the profile of the first cam body aperture are configured to prevent substantial rotation of the cam shaft within the aperture.

7. The dual cam lock apparatus of claim 6, further comprising a cam shaft fastener which fastens to the cam shaft to retain the first cam on the cam shaft.

8. The dual cam lock apparatus of claim 7, wherein the cam shaft fastener releasably fastens to the cam shaft.

9. The dual cam lock apparatus of claim 7, wherein the second cam body comprises a second cam body aperture therethrough which receives the cam shaft with the cam shaft fastener thereon with an annular space between the cam shaft fastener and the second cam body.

10. The dual cam lock apparatus of claim 9, wherein the at least one slot comprises a pair of opposed curved slots spaced around the second cam body aperture and the at least one protrusion comprises a pair of protrusions, wherein each one of the pair of protrusions is received in one of the pair of opposed curved slots.

11. The dual cam lock apparatus of claim 1, further comprising a protrusion fastener which fastens to an end of the at least one protrusion to couple the first cam to the second cam.

12. The dual cam lock apparatus of claim 11, wherein the protrusion fastener releasably fastens to the end of the at least one protrusion.

13. The dual cam lock apparatus of claim 1, wherein the second arm contacts the locking blade and moves the locking blade between the locking and release position, and a surface of the second arm that contacts the locking blade is curved.

14. The dual cam lock apparatus of claim 1, wherein the locking blade comprises a blade body and a tab in a plane substantially perpendicular to the blade body, wherein the tab comprises a slot and the second arm extends through the slot and moves the locking blade between the locking and release position through rotation of the second cam.

15. The dual cam lock apparatus of claim 14, wherein the blade body comprises a body portion and a neck portion and the tab is upstanding from the neck portion.

16. The dual cam lock apparatus of claim 14, wherein a surface of the second arm that is in contact with the tab during movement of the locking blade is curved.

17. The dual cam lock apparatus of claim 14, wherein the first arm abuts a surface of the tab to retain the locking blade in the locking position.

18. The dual cam lock apparatus of claim 17, wherein the first arm comprises a shoulder on a surface thereof and the surface of the tab jams against the shoulder when there is forced movement of the locking blade.

19. The dual cam lock apparatus of claim 1, wherein the locking blade comprises a male engagement member and the male engagement member comprises one or more than one teeth on an edge of the locking blade.

20. The dual cam lock apparatus of claim 1, wherein the locking blade moves linearly between the locking and release position.

21. The dual cam lock apparatus of claim 20, wherein the locking blade comprises one or more than one slot therethrough for receiving a pin, wherein the one or more than one slot is dimensioned to allow linear movement of the locking blade between the locking and release position.

22. A housing comprising the dual cam lock apparatus of claim 1 coupled to an inside surface of the housing for releasably locking the housing, wherein the locking blade comprises one of a male or female engagement member for releasably engaging with the other of the male or female engagement member positioned on the housing.

23. The housing of claim 22, wherein the housing comprises a cabinet with a door.

24. The housing of claim 23, wherein the dual cam lock apparatus is mounted on an internal surface of the cabinet and the door comprises the other of the male or female engagement member.

25. The housing of claim 24, wherein the door comprises one or more than one female engagement member and the locking blade comprises one or more than one male engagement member.

26. A dual cam lock comprising:

a rotatable lock comprising a cam shaft;

a first cam comprising a first cam body rotationally coupled with the cam shaft, at least one protrusion upstanding from a surface of the first cam body, and a first arm extending from the first cam body wherein a portion of the first arm is longitudinally extended and extends beyond an outer edge of the first cam body with a gap between the longitudinally extended portion of the first arm and the first cam body, wherein the first cam is rotatable by the cam shaft between a lock and unlock position; and a second cam comprising a second cam body with at least one slot therethrough which receives the at least one protrusion and a second arm extending from the second cam body, wherein the at least one slot has an angular span across which the at least one protrusion rotates before further rotation of the at least one protrusion causes rotation of the second cam.

27. The dual cam lock of claim 26, wherein the first cam is substantially C-shaped.

28. The dual cam lock of claim 26, wherein the longitudinally extending portion of the first arm has an internal edge surface facing the first cam body and an opposed external edge surface, and the internal edge surface has a shoulder thereon.

29. The dual cam lock of claim 26, wherein the longitudinally extending portion of the first atm has an internal edge surface facing the first cam body and an opposed external edge surface, and the external edge surface includes a tab with a raised profile compared to the profile of the external edge surface.

* * * * *